US007243626B2

(12) United States Patent
Strauss et al.

(10) Patent No.: US 7,243,626 B2
(45) Date of Patent: Jul. 17, 2007

(54) CAMSHAFT ADJUSTER

(75) Inventors: Andreas Strauss, Forchheim (DE); Andreas Rohr, Heroldsbach (DE); Jens Hoppe, Erlangen (DE); Viktor Lichtenwald, Nuremberg (DE); Jochen Auchter, Weisendorf (DE); Rainer Ottersbach, Aurachtal (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/124,841

(22) Filed: May 9, 2005

(65) Prior Publication Data

US 2005/0252467 A1 Nov. 17, 2005

(30) Foreign Application Priority Data

May 14, 2004 (DE) ..... 10 2004 023 976

(51) Int. Cl.
*F01L 1/34* (2006.01)

(52) U.S. Cl. ..... 123/90.17; 123/90.15; 123/90.12; 123/90.31; 384/107; 384/121; 384/123

(58) Field of Classification Search ..... 123/90.17
See application file for complete search history.

(56) References Cited

U.S. PATENT DOCUMENTS

| | | | | |
|---|---|---|---|---|
| 6,035,817 | A * | 3/2000 | Uchida | 123/90.17 |
| 6,076,492 | A * | 6/2000 | Takahashi | 123/90.17 |
| 6,363,896 | B1 * | 4/2002 | Speier | 123/90.17 |
| 6,640,757 | B2 * | 11/2003 | Uchida | 123/90.12 |
| 6,871,621 | B2 * | 3/2005 | Palesch et al. | 123/90.17 |

* cited by examiner

*Primary Examiner*—Thomas Denion
*Assistant Examiner*—Kyle M. Riddle
(74) *Attorney, Agent, or Firm*—Volpe and Koenig, P.C.

(57) ABSTRACT

A device for changing the control times of an internal combustion engine (camshaft adjuster (1)) having a pressure medium distributor (21) arranged within a camshaft (11) is provided. The pressure medium distributor (21) is provided at its front end with a radially extending shoulder (42), this shoulder (42) forming part of the camshaft axial mounting.

14 Claims, 4 Drawing Sheets

CAMSHAFT ADJUSTER

FIELD OF THE INVENTION

The invention relates to a camshaft adjuster for adjusting and fixing the phase position of a camshaft of an internal combustion engine in relation to a phase position of its crankshaft, having a timing gear which is driven by the crankshaft, an output part which is secured on the camshaft, is attached to a camshaft or to an extension of the camshaft and is driven by the timing gear via a hydraulic actuating drive, the actuating drive comprising at least one pair of hydraulic pressure chambers operating towards each other, and the pressure chambers being supplied with pressure medium via a pressure medium distributor and pressure medium lines.

BACKGROUND

Camshafts are used in internal combustion engines in order to actuate the gas exchange valves. The camshaft is fitted in the internal combustion engine in such a manner that cams fitted on it bear against cam followers, for example bucket tappets, drag levers or rocker arms. If the camshaft is caused to rotate, the cams roll off along the cam followers which in turn actuate the gas exchange valves. The position and the shape of the cams therefore define both the opening period and amplitude but also the opening and closing time of the gas exchange valves.

Modern engine concepts are based on the valve drive being of variable configuration. On the one hand, the valve stroke and valve opening period are to be able to be variable until individual cylinders are completely shut down. For this purpose, concepts, such as switchable cam followers or electro-hydraulic or electric valve-actuating means are provided. Furthermore, it has proven advantageous to be able to have an effect on the opening and closing times of the gas exchange valves during the operation of the internal combustion engine. It is likewise desirable to be able to have an effect on the opening and closing times of the inlet and outlet valves separately in order, for example, to be able to set a defined valve overlap in a specific manner. The specific setting of the opening and closing times of the gas exchange valves as a function of the current range of performance characteristics of the engine, for example of the current speed of rotation or the current load, makes it possible to reduce the specific fuel consumption, to have a positive effect on the exhaust behaviour, and to increase the engine efficiency, the maximum torque and the maximum power.

The described variability in controlling the timings of the gas exchange valves is brought about by means of a relative change of the phase position of the camshaft with respect to the crankshaft. In this case, the camshaft is in direct drive connection with the crankshaft generally via a chain drive, belt drive or gear drive. A camshaft adjuster which transmits the torque from the crankshaft to the camshaft is fitted between the chain drive, belt drive or gear drive, which is driven by the crankshaft, and the camshaft. This device is designed in such a manner that the phase position between the crankshaft and camshaft is securely held during the operation of the internal combustion engine and, if desired, the camshaft can be rotated over a certain angular range relative to the crankshaft.

In internal combustion engines having a respective camshaft for the inlet valves and the outlet valves, the said valves can be equipped with a respective camshaft adjuster. As a result, the opening and closing times of the inlet and outlet gas exchange valves can be displaced in time relative to one another and the timing overlaps can be set in a specific manner.

Modern camshaft adjusters are generally seated at the drive end of the camshaft. The said camshaft adjuster comprises a timing gear secured on the crankshaft, an output part secured on the camshaft and an adjusting mechanism transmitting the torque from the timing gear to the output part. The timing gear can be designed as a chain wheel, belt wheel or gear wheel and is connected in a rotationally fixed manner to the crankshaft by means of a chain, a belt or a gear drive. The adjusting mechanism can be operated electrically, hydraulically or pneumatically.

In the case of the hydraulically operated camshaft adjusters, a differentiation is made between "axial piston adjusters" and "rotary piston adjusters".

In the case of the axial piston adjusters, the timing gear is connected to a piston via a helical toothing. Furthermore, the piston is connected to the output part likewise via a helical toothing. The piston separates a cavity, which is formed by the output part and the timing gear, into two pressure chambers arranged axially with respect to each other. If the one pressure chamber is acted upon by a hydraulic medium while the other pressure chamber is connected to an oil outlet, then the piston is displaced in the axial direction. By means of the two helical toothings, this axial displacement causes the timing gear to be rotated relative to the output part and therefore the camshaft to be rotated relative to the crankshaft.

In a rotary piston adjuster, the timing gear is connected in a rotationally fixed manner to a stator. The stator and the output part are arranged concentrically with each other. The radial intermediate space between these two components accommodates at least one, but generally a number of, cavities which are spaced apart in the circumferential direction. The cavities are bounded in a pressure tight manner in the axial direction by means of side walls. A vane connected to the output part extends into each of these cavities. This vane divides each cavity into two pressure chambers. By means of specific connection of the individual pressure chambers to a hydraulic medium pump or a hydraulic medium outlet, the phase of the camshaft can be set or maintained relative to the crankshaft.

In order to control the camshaft adjuster, sensors detect the characteristic data of the engine, such as, for example, the load state and the speed of rotation. These data are supplied to an electronic control unit which, after comparison of the data with data on the performance characteristics of the internal combustion engine, controls the adjusting motor of the camshaft adjuster and the inflow and the outflow of hydraulic medium to/from the various pressure chambers.

The axial position of the camshaft in the cylinder head of an internal combustion engine is determined by an axial bearing acting on two sides. Ideally, this is situated at the camshaft-adjuster end of the camshaft. This avoids displacements of the control drive plane due to thermal lengthening of the camshaft under operating conditions.

An axial bearing of this type is disclosed, for example, in DE 199 58 629 A1. In this case, the axial bearing comprises an encircling radial web which is designed integrally with the camshaft and engages in an annularly encircling groove of a bearing shell. This design of an axial mounting of the camshaft is not suitable in the case of use of a camshaft adjuster with a central valve which is controlled by a central magnet, since large tolerances result due to the interaction of various components between the camshaft axial bearing and central magnet. A central magnet having a large stroke is therefore required, as a result of which the axial overall length of the camshaft adjuster is considerably enlarged.

DE 100 13 877 A1 presents a device for changing the control times of gas exchange valves of an internal combustion engine, the camshaft axial bearing formed on that side of the camshaft adjuster which faces away from the cam. A pressure medium adapter is connected by means of a fastening screw to a component of the camshaft adjuster that is fixed on the camshaft. A radially extending collar is formed on that side of the pressure medium adapter which faces away from the camshaft adjuster. In addition, a washer is arranged between the pressure medium adapter and the camshaft adjuster. The collar of the pressure medium adapter and the washer form an annularly encircling groove on the outer circumferential surface of the pressure medium adapter, into which a component secured on the cylinder head, such as, for example, the cylinder head itself, a bearing bridge or a housing part engages. As a result, the camshaft is secured against axial displacement in relation to the cylinder head.

This design of an axial mounting of a camshaft by means of a washer and a pressure medium adapter, which is fitted on that side of the camshaft adjuster which faces away from the cam, permits the use of a central valve fitted within the camshaft or the rotor of the camshaft adjuster. In this solution, the small number of components between the camshaft axial bearing and the central magnet necessary for adjusting the central valve means that the tolerance chain and therefore the stroke and therefore axial overall length of the central magnet can be reduced.

A disadvantage in this embodiment is the large number of components required for the axial mounting of the camshaft. In addition to higher costs and weight of the additional components, this results in an increased outlay on installation. In addition, installation errors, such as, for example, the inadvertent omission of the shim, are possible.

SUMMARY

The invention is therefore based on the object of avoiding these disadvantages described and of providing a camshaft adjuster having a pressure medium distributor arranged coaxially with the camshaft, with the tolerance chain between the camshaft axial bearing and pressure distributor being shortened and the number of components of the camshaft axial bearing being minimized.

According to the invention, this object is achieved in that the pressure medium distributor and the camshaft adjuster together with a component secured on the cylinder head form a camshaft axial bearing. In this case, the component which is secured on the cylinder head may be, for example, the cylinder head itself, a bearing bridge or a housing part.

In the present invention, a camshaft adjuster is fastened in a rotationally fixed manner to a hollow section of a camshaft which is of at least partially hollow design. The camshaft reaches through the central bore of the output part of the camshaft adjuster, it extending in the axial direction over the region of the camshaft adjuster. Of course, it is also conceivable that, instead of the camshaft, an extension of the camshaft reaches through the camshaft adjuster, for which reason camshaft below is understood either as meaning a camshaft or an extension thereof.

The camshaft adjuster essentially comprises a timing gear, an output part and various housing parts, with at least two pressure chambers acting towards each other being formed within these housing parts. In the present invention, the output part is fastened to the camshaft positively, frictionally, non-positively or with a cohesive material joint. The camshaft is of hollow design at the front end which reaches through the camshaft adjuster. A pressure medium distributor is arranged in the interior of the camshaft. The pressure medium distributor conducts pressure medium to the two pressure chambers acting towards each other. In this case, the pressure medium distributor can be designed either as a pressure medium adapter or as a central valve. If the pressure medium distributor is designed as a central valve, then the latter is advantageously actuated by an electromagnetic actuating device directly adjoining the central valve.

The pressure medium distributor protrudes over the camshaft in the axial direction on that side of the camshaft adjuster which faces away from the cams and is connected to the said camshaft non-positively, with a cohesive material joint or positively. On the front end protruding out of the camshaft, the pressure medium distributor is provided with a shoulder which extends radially and protrudes in the radial direction over the camshaft.

In the fitted state, there is therefore a groove encircling annularly around the camshaft between the camshaft adjuster and the radial shoulder of the pressure medium distributor. Part of the cylinder head, of a bearing bridge or of a housing engages in this groove. In interaction with the component secured on the cylinder head, the radial shoulder of the pressure medium distributor now prevents the camshaft from migrating axially further into the cylinder head. Equally, in interaction with the component secured on the cylinder head, the camshaft adjuster prevents the camshaft from migrating in the axially opposed direction. In this case, it is conceivable either for part of the housing or for the output part of the camshaft adjuster to serve as a stop surface for that part of the bearing which is secured on the cylinder head.

By means of the formation of a stop surface of the axial bearing on the camshaft adjuster and on a pressure distributor seated centrally in the camshaft, the number of components and therefore the costs and the outlay on installation of the unit are minimized. When a central valve is used as the pressure medium distributor, the number of components can be further minimized in comparison to a valve which is arranged outside the camshaft adjuster and by which the pressure chambers are supplied with pressure medium via a pressure medium adapter. Since the central valve itself is part of the camshaft axial bearing, the tolerance chamber between the camshaft axial bearing and central valve is reduced to a minimum, thus enabling the stroke of the central magnet which controls the central valve to be of small dimensions. As a result, the axial construction space of the central magnet and therefore of the entire unit can be minimized.

In a further embodiment according to the invention, the object is achieved in that the pressure medium distributor on its own, together with a component secured on the cylinder head, forms a camshaft axial bearing. As in the first embodiment, a camshaft, which is of at least partially hollow design, reaches through a bore of a camshaft adjuster. The camshaft is of hollow design at its front end which reaches through the camshaft adjuster. Furthermore, this end of the camshaft protrudes over the camshaft adjuster in the axial direction. The camshaft adjuster, which essentially comprises a drive part, an output part and housing parts, is fastened to the camshaft non-positively, frictionally, positively or with a cohesive material joint. At the drive end, a pressure medium distributor is placed into the hollow section of the camshaft. The said pressure medium distributor extends in the axial direction from the camshaft adjuster to beyond the front end of the camshaft. The pressure medium distributor may be designed as a pressure medium adapter. In this case, it is provided with at least two pressure medium passages through which the camshaft adjuster is supplied with pressure medium via bores in the camshaft. The use of a central valve which essentially comprises a sleeve provided with bores and a control piston arranged within the sleeve is likewise conceivable. At the front end of the pressure medium distributor, which end protrudes out of the camshaft, the said pressure medium distributor is formed with a radially extending shoulder, the shoulder protruding over the camshaft in the radial direction. The pressure medium distributor is connected to the camshaft non-positively, with a cohesive material joint or positively.

In the fitted state, the front drive end of the camshaft is situated in the axial direction within a component secured on the cylinder head, such as, for example, the cylinder head itself, a bearing bridge or a cover. The component secured on the cylinder head is provided with a bore in which the camshaft is arranged. An annular groove in which the radially protruding shoulder of the pressure medium distributor engages is formed on the inner circumferential surface of the bore. In interaction with the component secured on the cylinder head, the radial shoulder of the pressure medium distributor thus forms the axial bearing of the camshaft.

The output part is advantageously pushed over the camshaft or the extension of the camshaft and is connected thereto non-positively, positively or with a cohesive material joint. Furthermore, the camshaft or the extension of the camshaft protrudes over the output part in the axial direction on that side of the camshaft adjuster which faces away from the cams. The pressure medium distributor is arranged within the camshaft, which is of at least partially hollow design, and can be designed as a pressure medium adapter or advantageously as a central valve. In the event of design as a central valve, provision is made to design the pressure medium distributor as a 4/3-way directional control valve. The pressure medium distributor is fastened in the camshaft non-positively, positively, with a cohesive material joint or by means of a screw connection and protrudes over the camshaft in the axial direction. The pressure medium distributor, on the side facing away from the camshaft adjuster, has a radially outwardly extending shoulder. In this case, provision is made for the shoulder to form part of the axial bearing with respect to the component secured on the cylinder head.

BRIEF DESCRIPTION OF THE DRAWINGS

Further features of the invention emerge from the description below and from the drawings, in which exemplary embodiments of the invention are illustrated in simplified form. In the drawings.

DETAILED DESCRIPTION OF THE PREFERRED EMBODIMENTS

Figure 1:
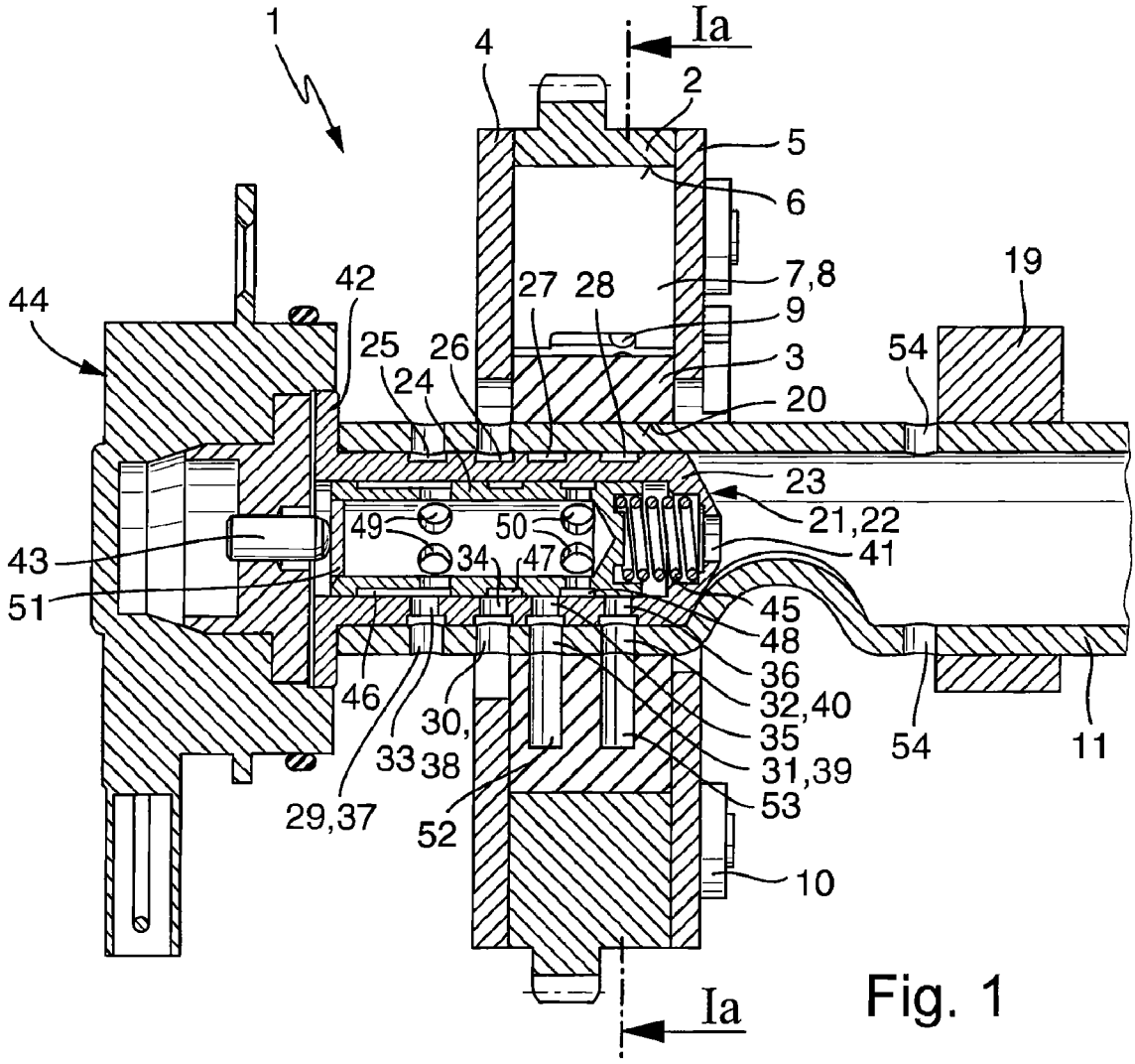
FIG. 1 shows a longitudinal section through a device for changing the control times of an internal combustion engine (camshaft adjuster) according to FIG. 1*a* along the line I-I, which shows the basic construction of a camshaft adjuster of the rotary piston type of construction.
Figure 1A:
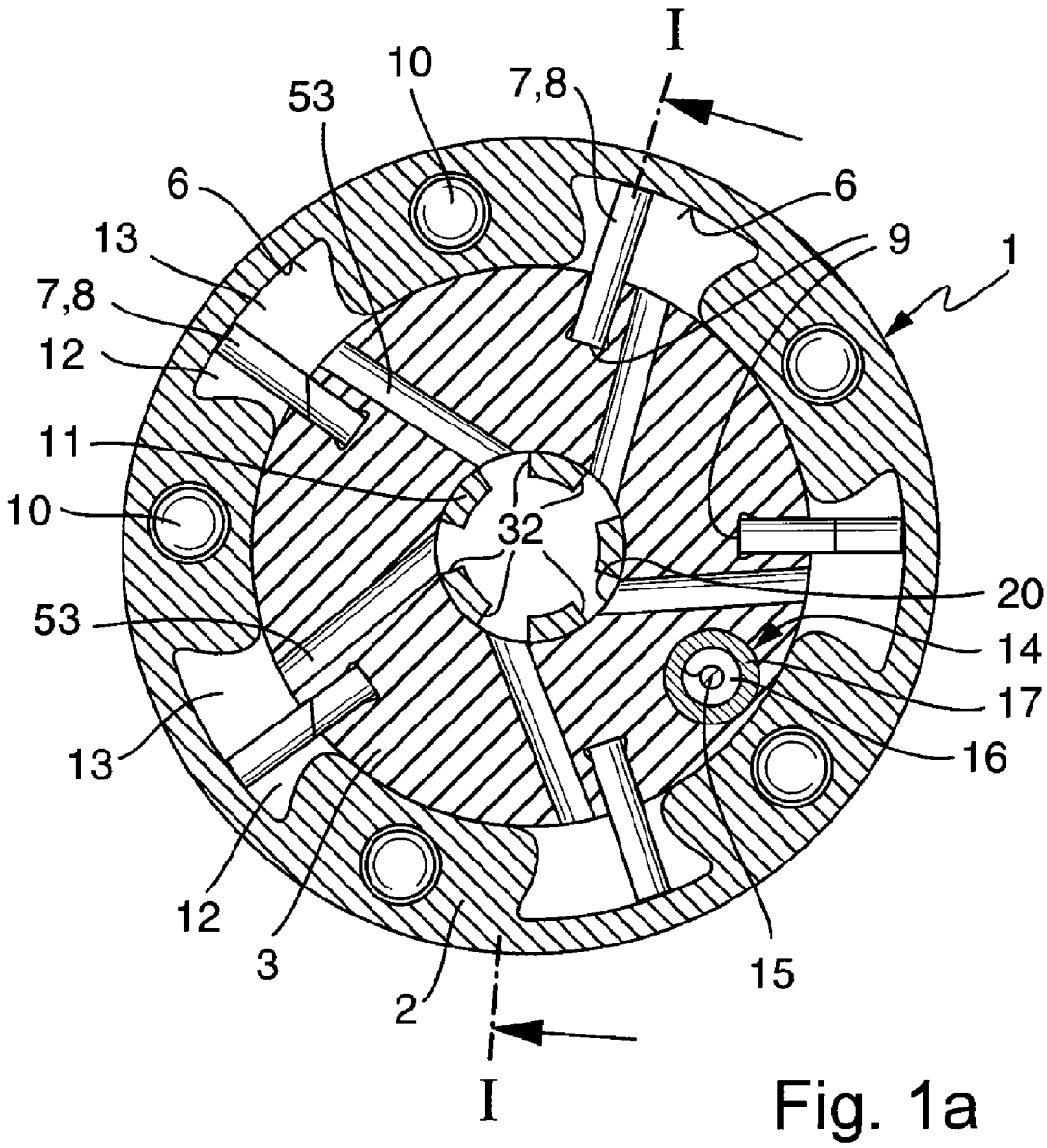
FIG. 1*a* shows a cross section through a device for changing the control times of an internal combustion engine (camshaft adjuster) according to FIG. 1 along the line Ia-Ia, without a pressure medium distributor, which line shows the basic construction of a camshaft adjuster of the rotary piston type of construction.
Figure 2:
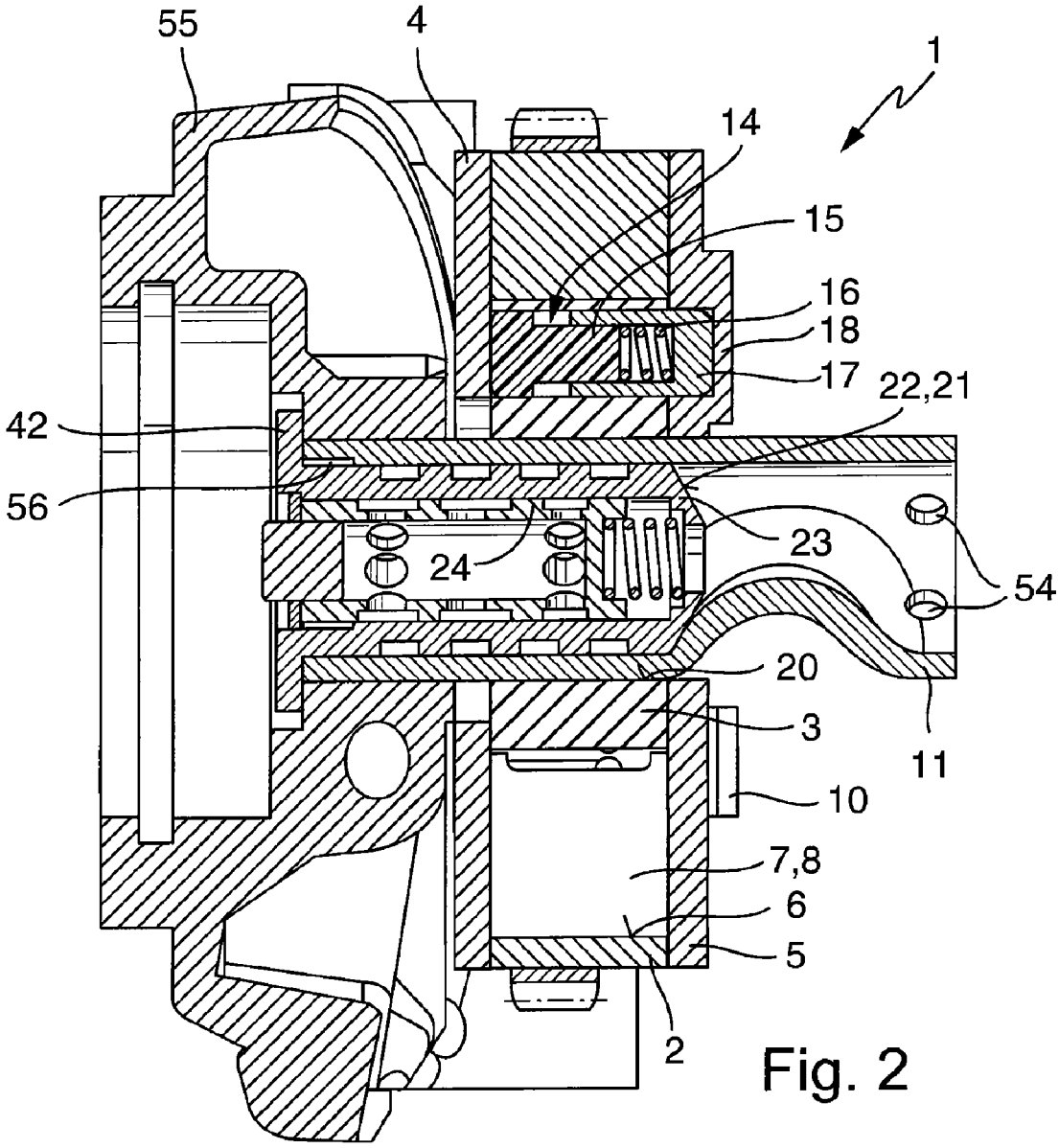
FIG. 2 shows a longitudinal section through a device according to the invention for changing the control times of an internal combustion engine according to FIG. 1 in the fitted state.
Figure 3:
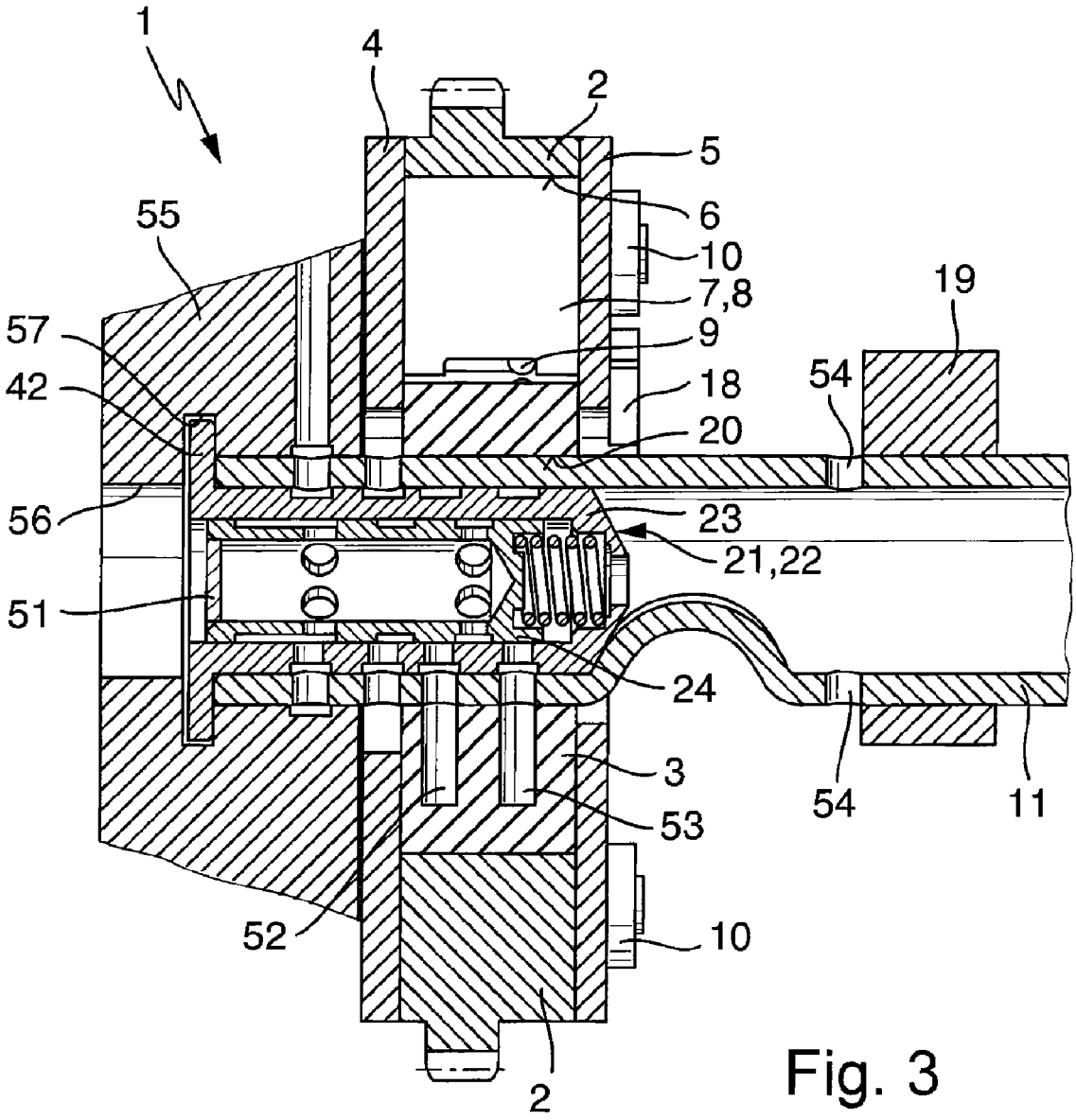
FIG. 3 shows a longitudinal section through a device according to the invention for changing the control times of an internal combustion engine according to FIG. 1 in a second installation state according to the invention.

FIGS. 1*a*, 1 to 3 show a device for changing the control times of an internal combustion engine (camshaft adjuster 1). FIGS. 1 and 1*a* illustrate the basic construction of a camshaft adjuster 1 in a rotary piston type of construction while FIGS. 2 and 3 illustrate two camshaft adjusters according to the invention in different mounting variants. In the embodiment illustrated, the camshaft adjuster 1 is illustrated as a rotary piston adjuster. However, other embodiments of hydraulically operated camshaft adjusters 1, such as, for example, axial piston adjusters, are likewise conceivable. The camshaft adjuster 1 essentially comprises a timing gear 2, an output part 3 and two side walls 4 and 5 of disc-shaped design. In the embodiment illustrated, the timing gear 2 is designed as a chain wheel which is connected via a drive chain to a crankshaft (not illustrated). However, embodiments are also conceivable in which the timing gear 2 is designed as a belt wheel or gear wheel which is driven by a toothed belt or gear drive, respectively, of the crankshaft. The timing gear 2 and the output part 3 are arranged concentrically with each other, with the radially inwardly situated circumferential surface of the timing gear 2 being provided with radial recesses 6 which engage in bulging formation 7 fitted on the output part 3. The bulging formations 7 can be expanded webs or vanes 8. The vanes 8 are arranged in grooves, which run axially and are formed in the circumferential surface of the output part 3, and are pressed in a sealing manner by means of a compression spring 9 against the radially inner surfaces of the recesses 6 of the timing gear 2.

In the axial direction, the camshaft adjuster 1 is bounded by the first and the second side wall 4, 5. In order to fasten the side walls 4 and 5 to the timing gear 2, fastening means, such as, for example, screws 10 are provided. The timing gear 2, the output part 3, the first and the second side wall 4, 5 form a plurality of pressure spaces which are separated from one another and are divided by the vanes 8 in each case into two pressure chambers 12, 13 acting towards each other. In order to adjust the phase of the camshaft 11 relative to the crankshaft, if, for example, the first pressure chambers 12 are supplied with pressure medium and the second pressure chambers 13 are connected to a pressure medium reservoir (not illustrated), then the vanes 8 fitted to the rotor are displaced in such a manner that the volume of the first pressure chambers 12 becomes larger and that of the second pressure chambers 13 becomes smaller. As a result, the rotor is rotated relative to the camshaft 11 in such a manner that the opening times of the gas exchange valves are displaced, for example, to an earlier time. In an analogous manner, the supply of the second pressure chambers 13 with pressure medium and the simultaneous connection of the first pressure chambers 12 to the pressure medium reservoir causes the opening times of the gas exchange valves to be adjusted to a later time.

In order to prevent the vanes 8 of the camshaft adjuster 1 from oscillating between their end positions in an uncontrolled manner in phases of insufficient pressure-medium supply, such as, for example, during the starting phase of the internal combustion engine, the camshaft adjuster 1 is provided with a locking device 14 (illustrated in FIG. 2) which keeps the output part 3 in these periods of time in a defined phase position with respect to the timing gear 2. A cartridge 15 which is supported on the first side wall 4 is arranged in an axial bore of the output part 3. The cartridge 15 is provided with an axially extending projection around which a spiral spring 16 is arranged. The spiral spring 16 acts upon a piston 17, which is of cup-like design, with a force in the direction of the second side wall 5, in which a slotted guide 18 is formed. In phases of insufficient pressure-medium supply, the piston 17 is held in the slotted guide 18 by the spring force and a fixed phase relationship between the camshaft 11 and crankshaft is therefore maintained. In order to deactivate the locking mechanism, the end side of the piston 17 that engages in the slotted guide 18 is acted upon with pressure medium, as a result of which the piston 17 is displaced counter to the spring force of the spiral spring 16 into the axial bore of the output part 3. In order to remove the leakage pressure medium collecting between the piston 17 and the cartridge 15, radially extending recesses are provided in the cartridge 15 and openings communicating therewith are provided in the first side wall 4.

The camshaft adjuster 1 is fastened on a camshaft 11 non-positively, positively, frictionally or with a cohesive material joint. The camshaft 11 bears one or more cams 19 and reaches through a bore 20 of the output part 3, it protruding in the axial direction over the camshaft adjuster 1 on the side facing away from the cam 19. The camshaft 11 is of hollow design at least at the front end which reaches through the camshaft adjuster 1. A pressure medium distributor 21 is placed within this cavity. The pressure medium distributor 21 may be a pressure medium adapter which connects the pressure chambers 12, 13, which act towards each other, to a pressure medium pump or to the pressure medium reservoir.

In the present example, the pressure medium distributor 21 is designed as a central valve 22. The central valve 22 comprises a valve body 23, which is of sleeve-shaped design, and a valve piston 24. The valve body 23 extends from the camshaft section, around which the camshaft adjuster 1 engages, in the axial direction to beyond the front drive end of the camshaft 11. In this case, the outside diameter of the valve body 23 is essentially matched to the inside diameter of the camshaft 11 and is connected to the latter non-positively, with a cohesive material joint or positively. Connecting methods, such as screwing, a press fit or bonding, are specified here by way of example. At the front end of the valve body 23 that protrudes out of the camshaft 11, the said valve body is provided with a radially extending collar 42 which extends in the radial direction beyond the camshaft 11.

The outer circumferential surface of the valve body 23 is provided with a first, a second, a third and a fourth annular passage 25, 26, 27, 28, the annular passages 25 to 28 being spaced apart axially from one another. Each of the annular passages 25 to 28 is designed as a reduction in diameter in the outer circumferential surface of the valve body 23 and communicates both with in each case one group of first to fourth openings 29, 30, 31, 32, which are introduced into the camshaft 11, and also with in each case one group of fifth to eighth openings 33, 34, 35, 36, which are introduced into the valve body 23 and connect the annular passages 25 to 28 to the interior of the central valve 22. In each case one of the group of openings 29 to 32, one of the group of openings 33 to 36 and the respective, associated annular passage 25 to 28 form a connection 37, 38, 39, 40. Furthermore, the front end of the valve body 23 that is situated in the camshaft 11 is provided with ninth opening 41 which vents the interior of the valve body 23 into the cavity of the camshaft 11 which is of at least partially hollow design.

A valve piston 24 of hollow design is arranged in an axially displaceable manner within the valve body 23. The valve piston 24 can be displaced in the axial direction via an actuating element 43 of an actuating device 44 counter to the restoring force of a spring 45 which acts on the valve piston 24 and is supported on the interior of the valve body 23. The actuating device 44 may be, for example, an electromagnet in which a permanent magnet connected to the actuating element 43 is arranged. By varying the current strength supplied to the electromagnet, the position of the permanent magnet and therefore the position of the actuating element 43 and therefore the position of the valve piston 24 can be changed in a specific manner.

The outer circumferential surface of the valve piston 24 is provided with a fifth to seventh annular passage 46, 47, 48 which, in turn, are designed as reductions in diameter in the outer circumferential surface of the valve piston 24. The fifth annular passage 46 is connected to the interior of the valve piston 24 via a tenth group of openings 49 and the seventh annular passage 48 via an eleventh group of openings 50. The interior of the valve 24 is of closed design with the exception of the tenth and eleventh openings 49, 50. In the embodiment illustrated, the valve piston 24 is of cup-shape design. The open front side of the valve piston 24 is closed in a pressure-tight manner by means of a disc-shaped element 51 which bears both against the valve piston 24 and against the actuating element 43.

The manner of operation of the camshaft adjuster 1 will be explained below. Pressure medium is supplied via the first connection 37 to the fifth annular passage 46. The fifth annular passage 46 communicates with the seventh annular passage 48 via the tenth and eleventh openings 49, 50. The fifth annular passage 46 is designed in such a manner that it communicates with the first connection 37 in each position of the actuating device 44.

In a first switching state of the central valve 22, which state corresponds to an unenergized state of the electromagnet of the actuating device 44, the valve piston 24 is displaced by the spring 45 in such a manner that it takes up a position at a minimal distance from the actuating device 44. In this position, the seventh annular passage 48 communicates via the third connection 39 with first pressure medium lines 52 which open into the first pressure chambers 12. At the same time, the pressure medium passes from the second pressure chambers 13 via second pressure medium lines 53 and the fourth connection 40 into the interior of the valve body 23 which is vented via the ninth opening 41 into the camshaft 11 and from there via vent bores 54 into the crank case. As a consequence, the control times of the gas exchange valves are adjusted to an earlier time.

In a second position of the valve piston 24, which position is illustrated in FIG. 1 and is taken up by feeding the electromagnet of the actuating device 44 with a medium current strength, the seventh annular passage 48 does not communicate either with the third or with the fourth connection 40, as a result of which the pressure medium flow is shut down and the current phase position between the camshaft 11 and crankshaft is maintained.

In a third position, a current of maximum current strength flows through the electromagnet of the actuating device 44. As a result, the valve piston 24 is brought into a position which is at the maximum distance from the actuating device 44. In this switching state of the central valve 22, the pressure medium is connected via the first connection 37, the fifth annular passage 46, the tenth and eleventh openings 49, 50, the seventh annular passage 48 and the fourth connection 40 to the second pressure medium lines 53 from where they open into the second pressure chambers 13. At the same time, the first pressure chambers 12 are connected via the first pressure medium lines 52, the third connection 39, the sixth annular passage 47 and the second connection 38 to the pressure medium reservoir. As a result, the opening times of the gas exchange valves are adjusted to a late time.

FIG. 2 shows a first fitting situation of a camshaft adjuster 1 according to the invention. The axial position of a camshaft 11 in the cylinder head of an internal combustion engine is determined by an axial bearing acting on two sides. Ideally, the latter is situated at the control-drive end of the camshaft 11 in order to avoid a displacement of the control drive plane due to thermal lengthening of the shaft under operating conditions. In the present case, the camshaft axial bearing is formed by the output part 3 of the camshaft adjuster 1, the radially extending shoulder 42 of the valve body 23 and a component 55 secured on the cylinder head. The component 55 which is secured on the cylinder head may be the cylinder head itself, a bearing bridge or a housing part. The component 55 secured on the cylinder head engages around the camshaft 11 in the region between the camshaft adjuster 1 and the radially extending shoulder 42. In this case, it bears on one side against the radially extending shoulder 42. In the embodiment illustrated, the component 55 secured on the cylinder head reaches on its side facing away from the shoulder 42 through the first side wall 4 of the camshaft adjuster 1 and bears against the output part 3. An axial displacement of the camshaft 11 is effectively prevented by this arrangement. The component 55 secured on the cylinder head is advantageously designed in such a manner that it does not reach through the first side wall 4 of the camshaft adjuster 1 over the entire circumference of the camshaft 11 in order to ensure that the pressure medium flows away effectively.

Of course, it is just as conceivable for the second axial bearing surface not to be formed on the output part 3 of the camshaft adjuster 1 but rather on the first side wall 4.

If a bearing bridge is provided as the component 55 which is secured on the cylinder head, then the said bearing bridge may be of single- or two-part design.

In the event of the single-part design, the camshaft adjuster 1 is first of all fixed on the camshaft 11 and the latter is placed into the cylinder head. The bearing bridge is pushed with a bearing bore over a free end of the camshaft 11. The central valve 22 is subsequently fixed within the camshaft 11 non-positively, with a cohesive material joint or positively. This can take place, for example, by means of screwing, a press fit or by bonding.

In the event of a two-part bearing bridge, the lower shell thereof may already be fastened to the cylinder head. In a first step, the camshaft 11 is placed with a fixed camshaft adjuster 1 and fixed central valve 22 into the lower shell. The upper part of the bearing bridge is then placed onto the lower shell and connected thereto.

FIG. 3 shows a further possibility of the axial mounting of the camshaft 11. The component 55 secured on the cylinder head is provided with a bore 56. The inner circumferential surface of the bore 56 is provided with an annularly encircling groove 57. The camshaft 11 is arranged in the bore 56 of the component 55 secured on the cylinder head in such a manner that the radially extending shoulder 42 of the valve body 23 engages in the annularly encircling groove 57 of the inner circumferential surface of the bore 56. In this case, the component 55 secured on the cylinder head is, of course, designed as a two-part component. On installation, the camshaft adjuster 1 is fitted on the camshaft 11. In this case, a lower shell of a bearing bridge is already fixed to the cylinder head. The camshaft 11 is placed with the fixed camshaft adjuster 1 and the pressure medium distributor 21 into the cylinder head. The upper part of the bearing bridge is then placed onto the lower part via the free end of the camshaft 11. Finally, the upper part and lower part are connected to each other, as a result of which the radially extending shoulder 42 together with the annularly encircling groove 57 produces the camshaft axial bearing.

REFERENCE NUMBERS

1 Camshaft adjuster
2 Timing gear
3 Output part
4 First side wall
5 Second side wall
6 Recesses
7 Bulging formations
8 Vane
9 Compression spring
10 Screw
11 Camshaft
12 First pressure chamber
13 Second pressure chamber
14 Locking device
15 Cartridge
16 Spiral spring
17 Piston
18 Slotted guide
19 Cam
20 Bore
21 Pressure medium distributor
22 Central valve
23 Valve body
24 Valve piston
25 First annular passage
26 Second annular passage
27 Third annular passage
28 Fourth annular passage
29 First opening
30 Second opening
31 Third opening
32 Fourth opening
33 Fifth opening
34 Sixth opening
35 Seventh opening
36 Eighth opening
37 First connection
38 Second connection
39 Third connection
40 Fourth connection
41 Ninth opening
42 Shoulder
43 Actuating element
44 Actuating device
45 Spring
46 Fifth annular passage
47 Sixth annular passage
48 Seventh annular passage
49 Tenth opening
50 Eleventh opening

51 Element
52 First pressure medium line
53 Second pressure medium line
54 Vent bores
55 Component secured on the cylinder head
56 Bore
57 Groove

The invention claimed is:

1. Camshaft adjuster for adjusting and fixing the phase position of a camshaft of an internal combustion engine in relation to a phase position of a crankshaft, comprising:

a timing gear which is driven by the crankshaft, an output part which is secured on the camshaft, attached to the camshaft or to an extension of the camshaft and is driven by the timing gear via a hydraulic actuating drive, the actuating drive comprising at least one pair of hydraulic pressure chambers operating towards each other, and the pressure chambers being supplied with pressure medium via a pressure medium distributor and pressure medium lines, the pressure medium distributor and the camshaft adjuster together with a component secured on the cylinder head form a camshaft axial bearing the camshaft or the extension of the camshaft protrudes over the output part in an axial direction on a side of the camshaft adjuster which faces away from the cam.

2. Camshaft adjuster according to claim 1, wherein the output part is pushed over the camshaft or the extension of the camshaft and is connected thereto non-positively, positively, or with a cohesive material joint.

3. Camshaft adjuster according to claim 1, wherein the pressure medium distributor is arranged within the camshaft which is at least partially hollow.

4. Camshaft adjuster according to claim 1, wherein the pressure medium distributor comprises a central valve.

5. Camshaft adjuster according to claim 1, wherein the pressure medium distributor comprises a 4/3-way directional control valve.

6. Camshaft adjuster according to claim 1, wherein the pressure medium distributor is fastened in the camshaft non-positively, positively, with a cohesive material joints, or via a screw connection.

7. Camshaft adjuster according to claim 1, wherein the pressure medium distributor includes the radially extending shoulder on a side facing away from the camshaft adjuster.

8. Camshaft adjuster for adjusting and fixing the phase position of a camshaft of an internal combustion engine in relation to a phase position of its crankshaft, comprising:

a timing gear which is driven by the crankshaft, an output part which is secured on the camshaft, attached to the camshaft or to an extension of the camshaft and is driven by the timing gear via a hydraulic actuating drive, the actuating drive comprising at least one pair of hydraulic pressure chambers operating towards each other, and the pressure chambers being supplied with pressure medium via a pressure medium distributor and pressure medium lines, the pressure medium distributor on its own, together with a component secured on the cylinder head, form a camshaft axial bearing, the camshaft or the extension of the camshaft protrudes over the output part in an axial direction on a side of the camshaft adjuster which faces away from the cam.

9. Camshaft adjuster according to claim 8, wherein the output part is pushed over the camshaft or the extension of the camshaft and is connected thereto non-positively, positively, or with a cohesive material joint.

10. Camshaft adjuster according to claim 8, wherein the pressure medium distributor is arranged within the camshaft which is at least partially hollow.

11. Camshaft adjuster according to claim 8, wherein the pressure medium distributor comprises a central valve.

12. Camshaft adjuster according to claim 8, wherein the pressure medium distributor comprises a 4/3-way directional control valve.

13. Camshaft adjuster according to claim 8, wherein the pressure medium distributor is fastened in the camshaft non-positively, positively, with a cohesive material joint, or via a screw connection.

14. Camshaft adjuster according to claim 8, wherein the pressure medium distributor has the radially extending shoulder on a side facing away from the camshaft adjuster.

* * * * *